US005355760A

United States Patent [19]

Bein et al.

[11] Patent Number: 5,355,760

[45] Date of Patent: Oct. 18, 1994

[54] MULTI-SOUND TAMBOURINE

[76] Inventors: Thomas W. Bein, 1283 Swan Dr., Annapolis, Md. 21401; Woodwerth C. Bein, III, 106 Philadelphia Ave., Lavallette, N.J. 08735

[21] Appl. No.: 135,437

[22] Filed: Oct. 13, 1993

[51] Int. Cl.[5] ..... G10D 13/02

[52] U.S. Cl. ..... 84/418

[58] Field of Search ..... 84/418, 422.1

[56] References Cited

U.S. PATENT DOCUMENTS 1,333,565 3/1920 Newlin ..... 84/418

4,688,462 8/1987 Greenspoon et al. ..... 84/418

*Primary Examiner*—Michael L. Gellner

*Assistant Examiner*—Patrick J. Stanzione

[57] ABSTRACT

An improved tambourine which generates additional sounds that supplement the conventional jingle sound using the same playing motion as the conventional tambourine. It is a feature of the invention that the player can adjust the effort required to generate the additional sounds so that the player can turn the additional sounds "on or off" simply by adjusting the playing effort. The invention is applicable to cylindrical as well as non-cylindrical tambourine frames. Implementations are also presented that are applicable to modifying existing tambourine frames to enable them to generate additional sounds to supplement the conventional jingle sound.

46 Claims, 9 Drawing Sheets

MULTI-SOUND TAMBOURINE

BACKGROUND OF THE INVENTION

This invention relates generally to a tambourine which is a percussion musical instrument used in contemporary music. Conventional tambourines are cylindrical in shape and include sounding elements that generate a jingle sound which are mounted on pins that are located in openings in the side of the circular frame. There is also a version of the tambourine that in addition to the jingles there is a drum head mounted to one of the open ends of the circular frame.

One limitation of the conventional tambourine is that it only makes the jingle sound. Many playing situations require additional sounds such as a knock sound. This is accomplished in practice by the player hitting the tambourine with a drum stick. This is acceptable for a drum set player however, for a singer or standing players this requires the use of both hands.

The present invention combines multiple sounds with the prior art while maintaining the acoustic qualities of the tambourine by providing a multi-sound tambourine that comprises a means to create the additional sounds without requiring the use of a drum stick or similar device while the jingle sound of the conventional tambourine is generated. The present invention also provides the means to control the amount of effort that is required by the player to create the additional sounds.

BRIEF DESCRIPTION OF THE INVENTION

A musical instrument which includes a rigid, open ended circular frame and a plurality of sounding elements such as jingles disposed in openings around the side of the frame at predetermined locations for creating a jingling sound used in contemporary music. The frame includes an area where there are no jingles where a handle is located for a player to grasp the instrument or where a clamp would be attached to mount the instrument to, for example, an instrument stand.

The jingles are mounted in the conventional manner on pins that are centered in the openings in the frame. There is a slot formed between the upper and lower rows of jingles that extends from one side of the handle to the other side of the handle. A clamp is provided in the slot that can be positioned along the slot to effectively change the amount of effort required to generate the knock sound in addition to the conventional jingle sound. The slot clamp can be adjusted so that the additional sound is eliminated completely, so that the multi-sound tambourine performs identically to the prior art, or the slot clamp can be adjusted so that the additional sound is made every time the tambourine jingle sound is made.

To operate the multi-sound tambourine as a conventional tambourine, the slot clamp is positioned approximately opposite to the handle and the multi-sound tambourine is grasped by the handle and moved manually so that the side of the circular frame is moved along the axis of the circular frame and the side of the frame opposite the handle is brought into contact with the palm of the player's hand. The position and the mounting of the jingles allows for and provides the conventional jingle sound in spite of the slot created for the additional sound. To create the additional sound each time the multi-sound tambourine contacts the palm of the player's hand, the slot clamp is moved to a position close to the handle. When the multi-sound tambourine is brought into contact with the palm of the player's hand, the upper and lower halves of the frame bend toward each other. When the two halves of the frame make contact with each other, the impact generates the additional sound, in this case a knock, combined with the jingle sound. The slot clamp can be relocated away from the handle so that more effort is required to create the additional sound. This is useful for situations where the player wants the additional sound combined with the jingle sound during parts of a song and wants only the jingle sound in other parts. With the slot clamp appropriately positioned, the player can produce the conventional jingle sound with the multi-sound tambourine by using minimal striking effort and can produce the combined jingle and knock sounds by simply increasing the striking effort.

For situations where it is desirable to have a knock as the additional sound, the volume or tone of the knock sound can be varied by mounting knock sound generating elements to the multi-sound tambourine. The knock sound generating elements are mounted to the circular frame opposite to the handle, on each side of the slot, spaced apart approximately the same distance as the width of the slot. When the multi-sound tambourine is brought into contact with the palm of the player's hand, the upper and lower halves of the frame bend toward each other which causes the knock sound generating elements to make contact with each other which generates the knock sound.

For tambourines with drum heads attached to one of the open ends of the frame the invention applies in an similar fashion. Due to the mass of the drum head, the amount of effort required to cause the two halves of the frame to contact each other changes depending on which side of the multi-sound drum head tambourine is brought into contact with the palm of the player's hand. In addition to the knock sound, a striker can be added to the multi-sound drum head tambourine which hits the drum head when the instrument is played, thereby adding a drum hit to the jingle and knock sounds.

The instrument may be constructed of conventional materials for the acoustic qualities desired. The jingles and their mounting configuration are conventional in acoustic character and construction and do not alone form a part of the invention. To generate sounds other the knock sound, the desired sound generating element, such as a cow bell, is mounted to the frame in place of the knock sound generating element. The shape of the frame for the multi-sound tambourine can be other than the conventional cylinder. The present invention to achieve the additional sounds can be readily applied to other shapes such as the crescent shape tambourine of Taninbaum U.S. Pat. No. 4,230,015.

It is an object of this invention to provide an improved tambourine which allows one to create additional sounds with the conventional jingle sound when played in the conventional manner.

It is another object of this invention to provide an improved tambourine which allows one to control the amount of effort required to produce the additional sounds with the conventional jingle sound when played in the conventional manner.

It is still yet another object of this invention to provide an improved tambourine with a drum head which allows one to produce the conventional jingle sound combined with a drum hit and other sounds when played in the conventional manner.

It is still yet another object of this invention to provide improvements that will convert an existing tambourine to a multisound tambourine that will produce additional sounds with the conventional jingle sound when played in the conventional manner.

In accordance with these and other objects which will be apparent hereinafter, the instant invention will now be described with particular reference to the accompanying drawings.

PREFERRED EMBODIMENT OF THE INVENTION–

Figure 1:
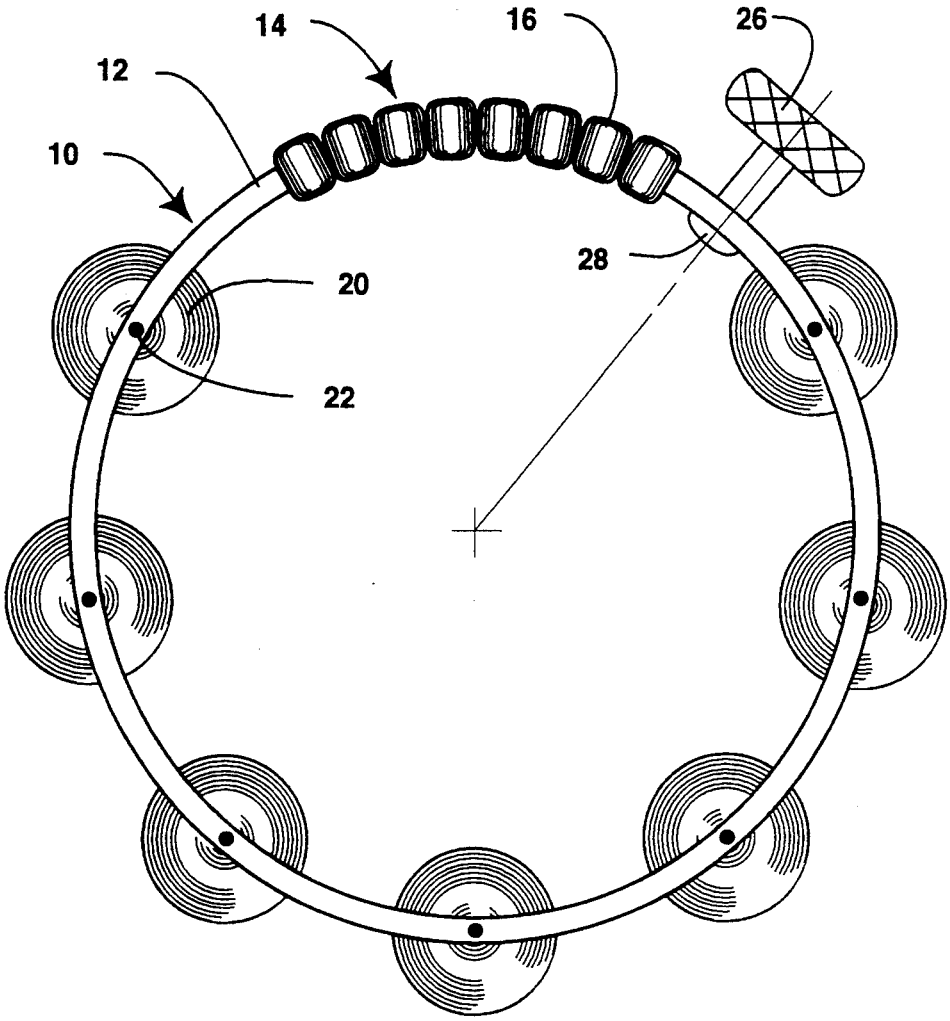
FIG. 1 is a top plan view of the instant invention.

Referring now to the drawings wherein like characters designate like or corresponding parts throughout the several views. A cylindrical frame is shown in all of the implementations to simplify the figures. The present invention can be readily applied to tambourine frames of non-circular shapes. FIG. 1 shows the present invention generally at 10 comprised of a cylindrical frame 12 and a handle 14 which includes suitable padding material 16. Sounding elements such as jingles 20 are mounted to the frame by pins 22 in a conventional manner. A slot clamp 26 is shown in a position that is adjacent to the edge of the handle padding 16 on a threaded post 28.

Figure 2:
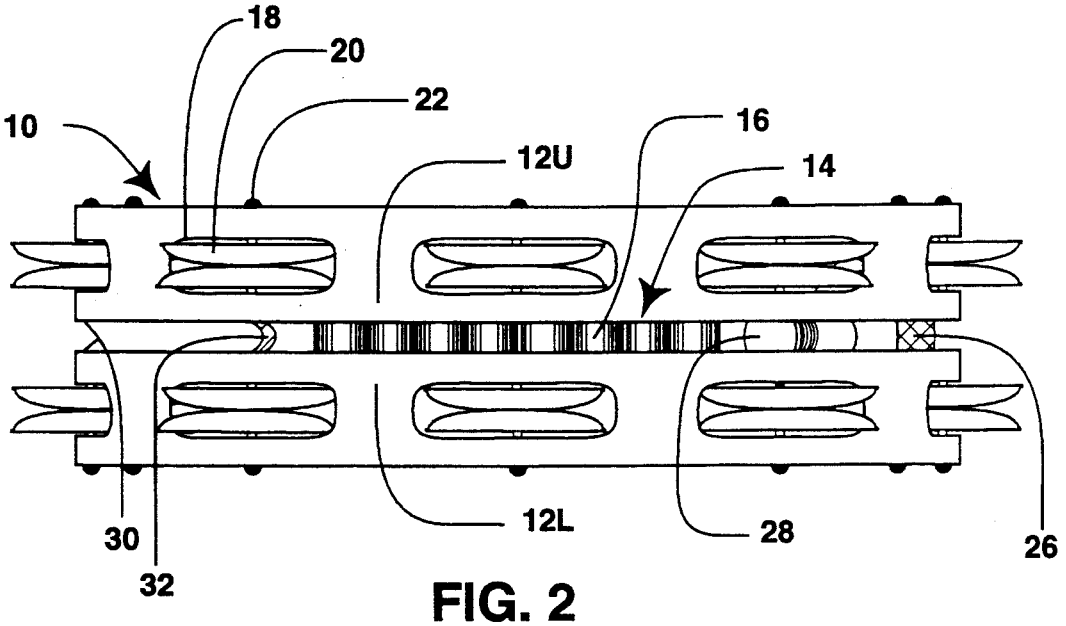
FIG. 2 is a side elevation view of the instant invention viewed from the side opposite the handle.

FIG. 2 is a side view of the present invention where a plurality of openings 18 are shown in the side of frame 12 to allow for the jingles 20 to be located. The slot 30 that is formed in said frame between the two rows of jingles extends from one side of the handle 14 to the other side of the handle with the end shown as 32. The opposite end of the slot is in the symmetrical location at the other end of the handle 14 but is covered from view by the end of the slot clamp 26 threaded post 28. Also shown in FIG. 2 is the relationship of the upper and lower halves of the frame, labeled 12U and 12L respectively. When the instrument is played and hit along the axis of the cylindrical frame 12 on the side of said frame opposite the handle 14, the upper and lower halves of the frame, 12U and 12L, will bend so that they contact each other. When the two halves impact each other, a knock sound is generated in addition to the sound generated by the jingles.

Figure 1A:
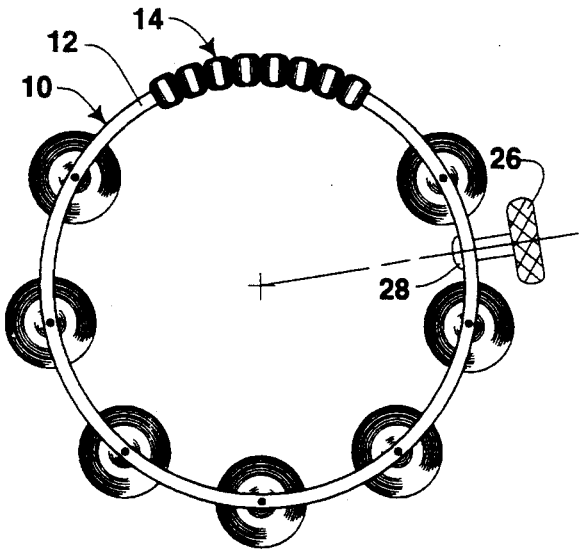
Figure 1B:
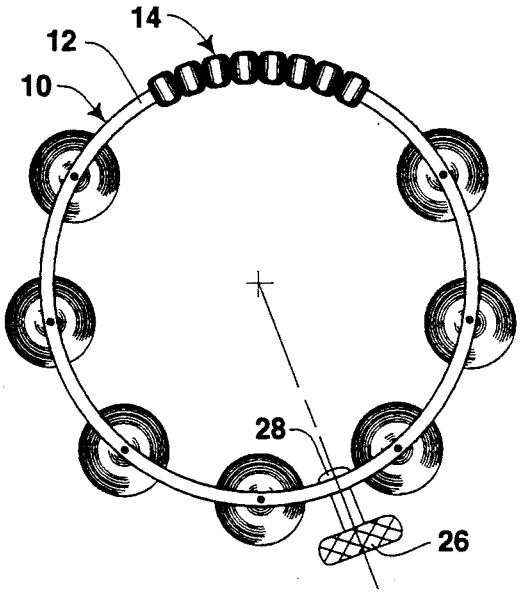

The effort required to cause the upper and lower halves of the frame, 12U and 12L respectively, to impact each other can be varied by moving the slot clamp 26 along the slot 30. The minimum effort is required when the slot clamp is positioned at the end of the slot 32, as shown in FIG. 1. When the slot clamp is moved away from the handle, as shown in FIG. 1A the effort required to generate the knock sound increases. When the slot clamp 26 is positioned on the side of the frame 12 opposite to the handle 14 as shown in FIG. 1B, the upper and lower halves, 12U and 12L respectively, will not be able to bend toward each other, therefore the knock sound will not be generated. This feature makes it possible to adjust the slot clamp 26 so that when the player strikes the instrument with minimal effort the jingle sound alone will be produced. When the player increases the striking effort, the knock sound and the jingle sound will be generated.

Figure 3:
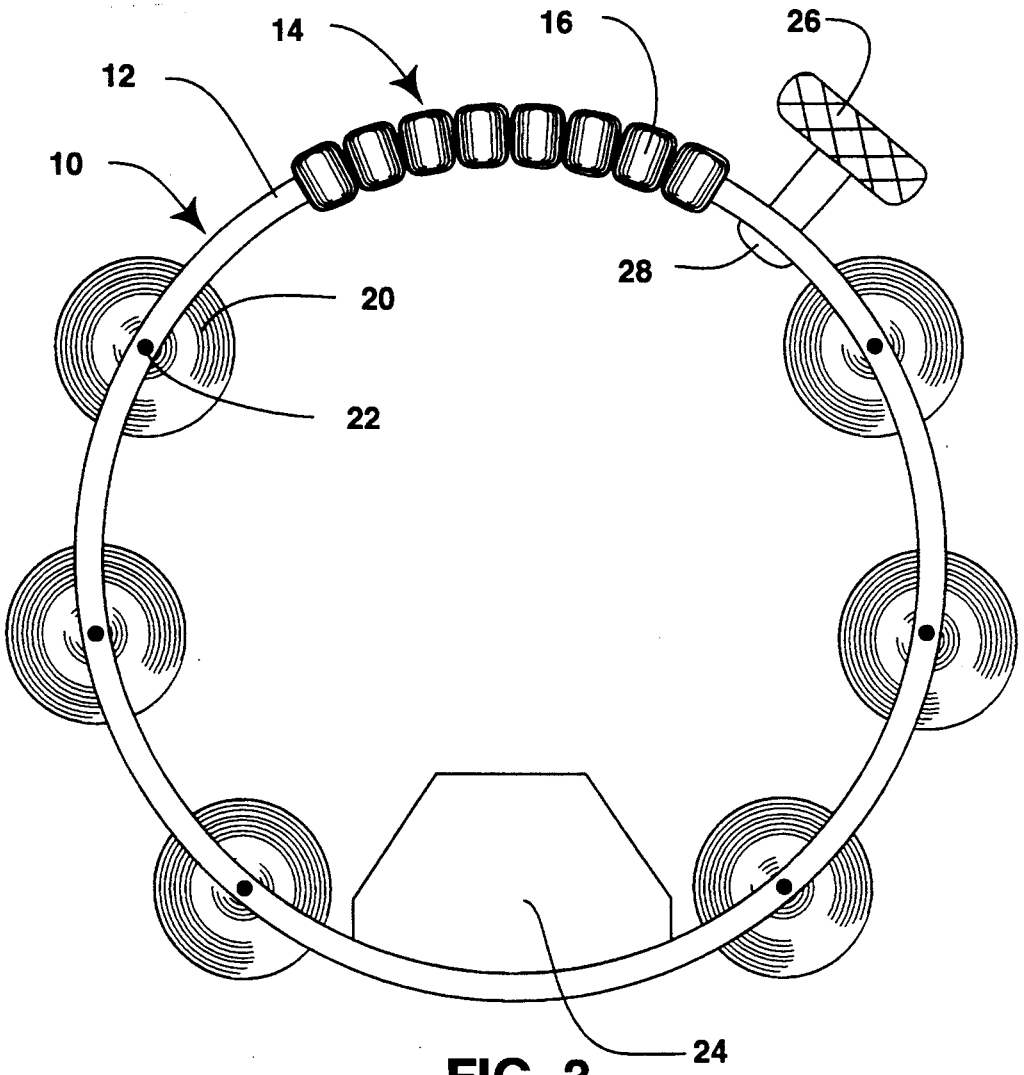
FIG. 3 is a top plan view of the instant invention with knock sound generating elements mounted to the frame.
Figure 4:
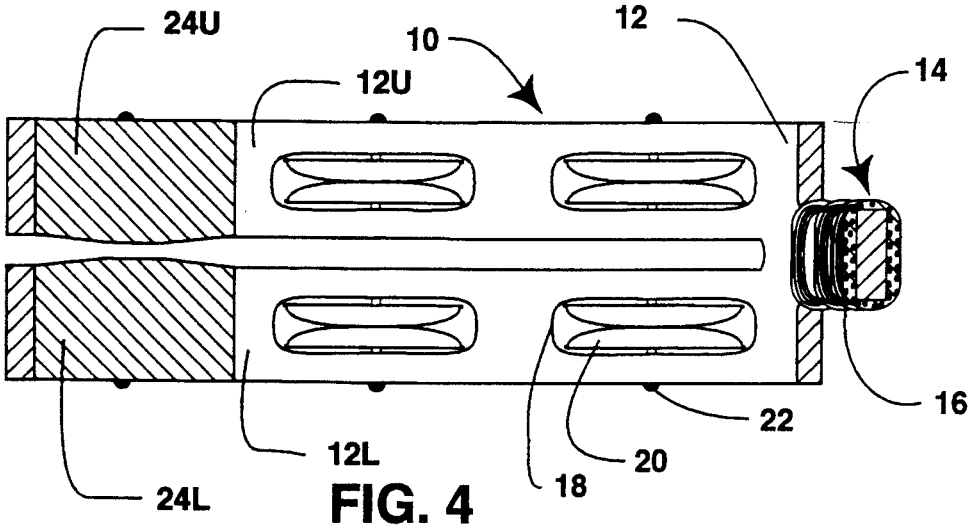
FIG. 4 is a cross section side view cut along the axis through the handle of the instant invention with knock sound generating elements mounted to the frame.

The tone or the amplitude of the knock sound generated by the multi-sound tambourine can be modified by the addition of knock sound generating elements 24 shown in FIG. 3. The knock sound generating elements 24 are mounted to the upper and lower halves of the frame, 12U and 12L respectively, opposite to the handle 14 with conventional means. The relationship of the two knock sound generating elements is shown in FIG. 4 where the upper knock sound generating element 24U is mounted to the upper halve of the frame 12U and the lower knock sound generating element 24L is mounted to the lower half of the frame 12L. The knock sound generating elements are mounted so that when the instrument is played and the two halves of the frame, 12U and 12L, bend toward each other, the knock sound generating elements impact each other and generate a knocking sound. The knock sound generating elements are constructed so that they have the desired acoustic tone and amplitude characteristics.

Figure 5:
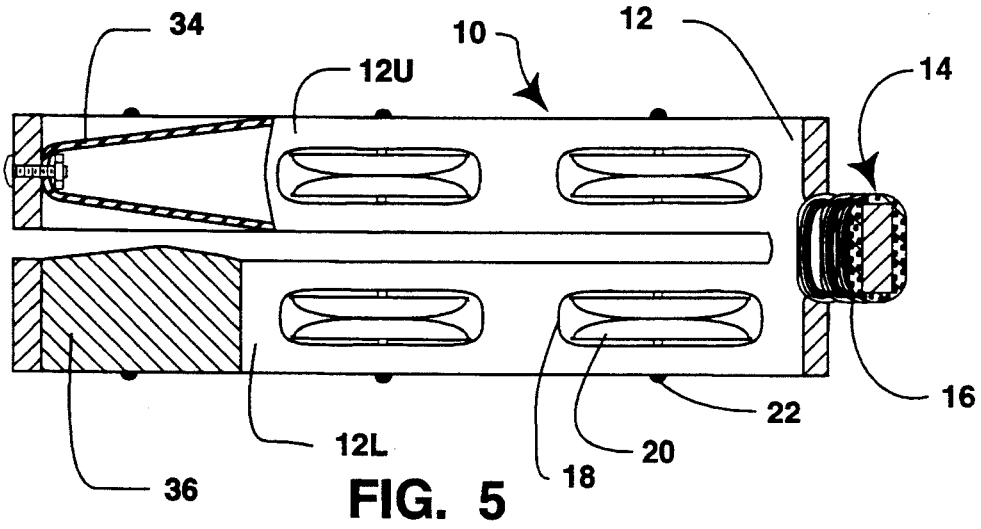
FIG. 5 is a cross section view cut along the axis through the handle of the instant invention with a sound generating element and striking element mounted to the frame.

Sounds other than a knock can be created by the present invention by mounting sound generating elements to the frame. For example, a cow bell 34 is shown in FIG. 5 mounted to the upper halve of the frame 12U. A striking element 36 is mounted to the lower half of the frame 12L. The cow bell 34 and the striking element 36 are mounted so that when the multi-sound tambourine is played and the two halves of the frame, 12U and 12L, bend toward each other, the striking element 36 impacts the cow bell 34 and generates the cow bell sound. The choice of sound generating element depends on the acoustic characteristics desired from the instrument. In addition, for sound generating elements such as the cowbell 34, the player can muffle the sound generated by touching said cowbell with his hand while the instrument is being played.

Figure 6:
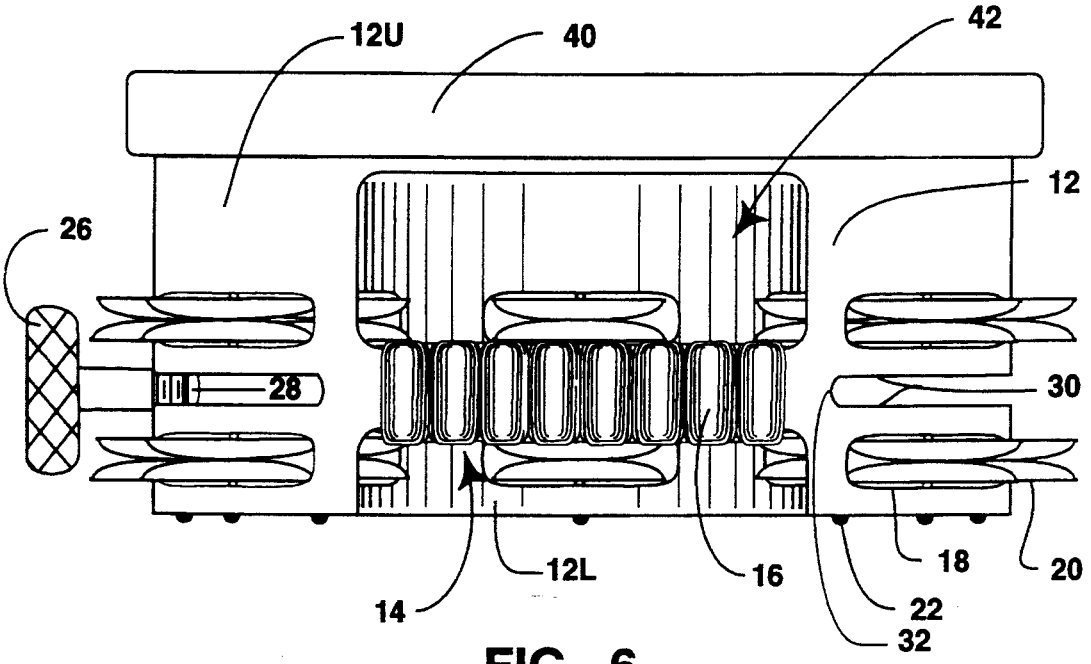
FIG. 6 is a side elevation view of instant invention with a drum head mounted to the frame viewed from the handle side.

The present invention is equally applicable to tambourines with a drum head assembly 40 on one of the open ends of the cylindrical frame, shown in FIG. 6. To provide sufficient space around the handle for the player's hand, the frame 12 is extended along the axis of the cylinder so that there is space for the handle opening 42. The knock sound is generated when the instrument is played and hit along the axis of the frame 12 on the lower half of the frame opposite the handle 14, the lower half of the frame, 12L, impacts the upper half of the frame 12U. The effort required to cause the lower half of the frame, 12L, to impact the upper half 12U can be varied by moving the slot clamp 26 along the slot 30. The knock sound is generated in addition to the sound generated by the jingles or by the drum head.

Figure 7:
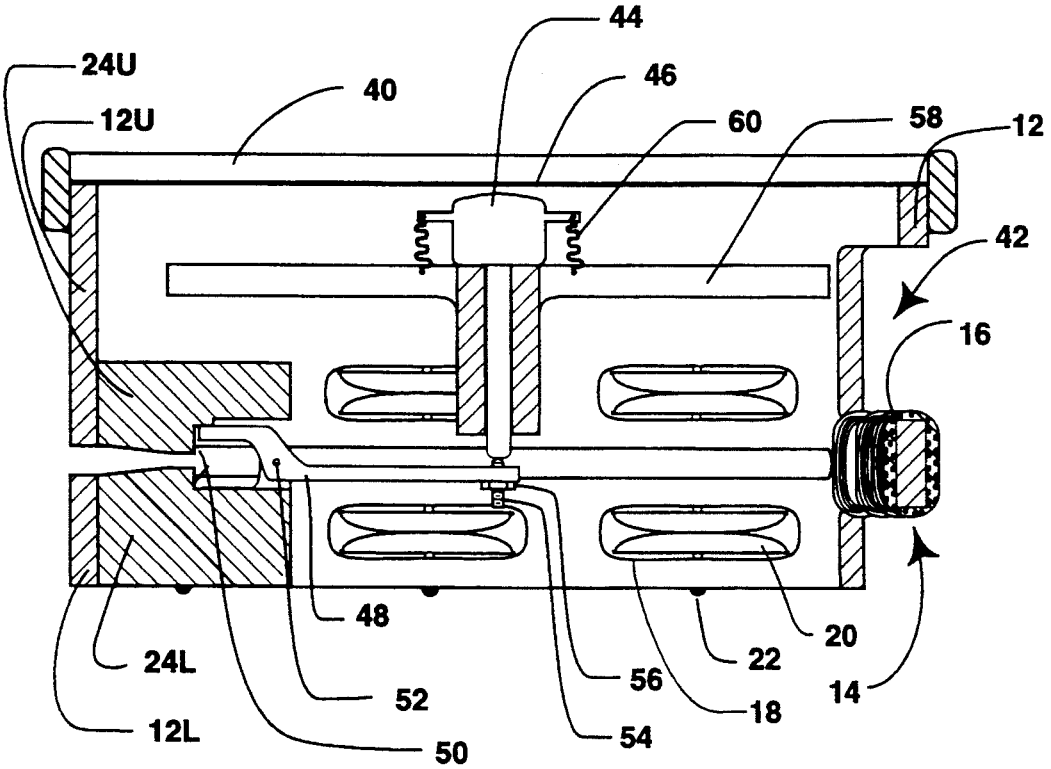
FIG. 7 is a cross section side view of the instant invention with a drum head mounted to the frame cut along the axis through the handle.

The tone or the amplitude of the knock sound generated by the instrument shown in FIG. 6 can be modified by the addition of knock sound generating elements 24 shown in FIG. 7. The upper knock sound generating element 24U is mounted to the upper halve of the frame 12U and the lower knock sound generating element 24L is mounted to the lower half of the frame 12L opposite to the handle 14 with conventional means. The instrument shown in FIG. 7 has the additional feature of a drum head striker 44 positioned to impact the drum head 46. The drum head striker 44 is forced into the drum head 46 by the striker lever 48 which moves when the two knock sound generating elements, 24U and 24L, are forced against each other when the instrument is played. Provisions are made to the knock sound generating elements, 24U and 24L, to provide a space 50 for the striker lever 48 to fit between said knock sound generating elements when said elements are touching. In addition, the lower knock sound generating element 24L is modified by adding the pivot 52 for the striker lever 48. The relationship between the drum head striker 44 and the striker lever 48 are adjusted by the position of the bolt 54 and locknut 56. The drum head striker 44 is mounted in the center of the cylindrical frame by a center support 58. The drum head striker 44 is pulled away from the head by return springs 60 which are attached to the head of the drum head striker 44 and to the center support 58. The knock sound generating elements are mounted so that when the instrument is played and the lower half of the frame, 12U, bends toward the upper half of the frame 12U, the knock sound generating elements, 24U and 24L, impact each other and generate a knocking sound. The knock sound generating elements are constructed so they have the desired acoustic tone and amplitude characteristics. The relative motion between the knock sound generating elements 24U and 24L when the instrument is played causes the striker lever 48 to push the drum head striker into the drum head 46 thereby generating the drum hit sound.

Figure 8:
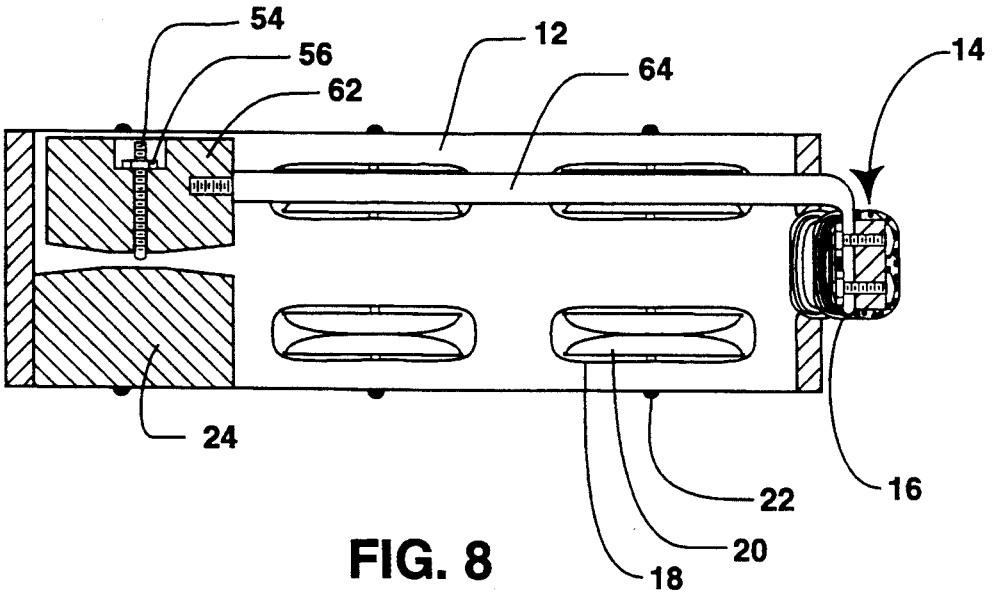
FIG. 8 is a cross section side view cut along the axis through the handle of the instant invention with a knock sound generating element mounted to the frame and the striking element mounted on a rod.

FIG. 8 shows an alternative implementation of the present invention comprised of a frame 12 and a handle 14 which includes suitable padding material 16. A knock sound generating element 24 is mounted to the frame with conventional means. A striking element 62 is mounted on a rod 64 that is attached with conventional means to the handle side of the frame. The knock sound is generated simultaneously with the sound generated by the jingles when the instrument is played and hit along the axis of the cylindrical frame 12 on the side of the frame opposite the handle 14, in the area where the knock sound generating element 24 is mounted. The rod that the striking element 62 is mounted to bends which permits the striking element 62 to impact the knock sound generating element 24. The distance between the striking element 62 and the knock sound generating element 24 is adjustable and is controlled by the position of the bolt 54 and the locknut 56. The amount of effort required to generate the knock sound is adjusted by changing the position of the bolt 54 which in turn changes the distance between the sound generating element 62 and the knock sound generating element 24.

An additional feature of the implementation shown in FIG. 8 is that the knock sound can be delayed to occur after the initial sound generated by the jingles. As shown in FIG. 8 this is achieved when the player hits the cylindrical frame 12 on the side of the frame opposite the handle 14, on the side of the frame opposite to the knock sound generating element. When the frame is hit, the conventional jingle sound is generated and the rod that the striking element 62 is mounted to bends away from the knock sound generating element 24. The distance that the striking element 62 will move away from the knock sound generating element 24 is proportional to the force of deceleration applied to the frame by the player. When the maximum distance between the striking element 62 and the knock sound generating element 24 is reached, there will be stresses in the rod 64 that are not in equilibrium. These unbalanced stresses in the rod 62 will return the striking element 62 back to and past its initial position. The striking element 62 will impact the knock sound generating element with a force proportional to the initial force applied to the frame 12 by the player. However, there will be a time delay between when the player hits the frame 12 and when the striking element 62 impacts the knock sound generating element 24 and generates the knock sound. The amount of time delay can be varied by the force applied by the player, the force required to bend the rod 64, the mass of the striking element 62, the distance between the striking element 62 and where the rod is attached to the frame, and the initial gap between the striking element 62 and the knock sound generating element 24.

Figure 9:
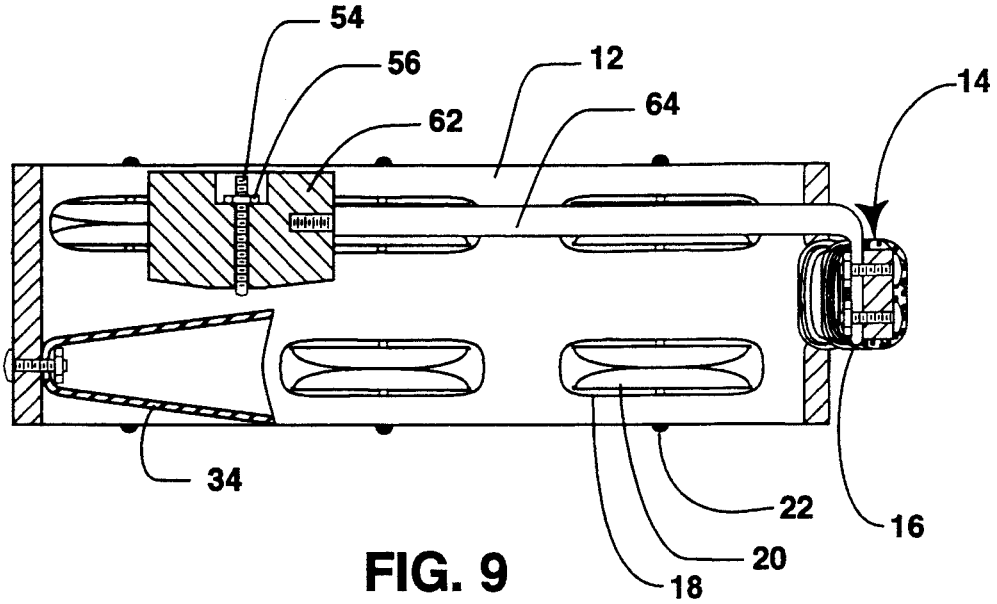
FIG. 9 is a cross section side view cut along the axis through the handle of the instant invention with a sound generating element mounted to the frame and a striking element mounted on a rod.

Sounds other than a knock can be created by the present invention by mounting a sound generating element such as a cow bell 34 to the frame 12 instead of the knock sound generating element 24, FIG. 9. The instrument functions identically to the description for FIG. 8 except that the additional sound generated is that of the sound generating element, shown as a cow bell 34. The sound generated by the cow bell 34 can be simultaneous with the jingle sound or it can be delayed simply by hitting the appropriate side of the frame as described for FIG. 8. In addition, for sound generating elements such as the cowbell 34, the player can muffle the sound generated by touching said cowbell with his hand while the instrument is being played.

Figure 10:
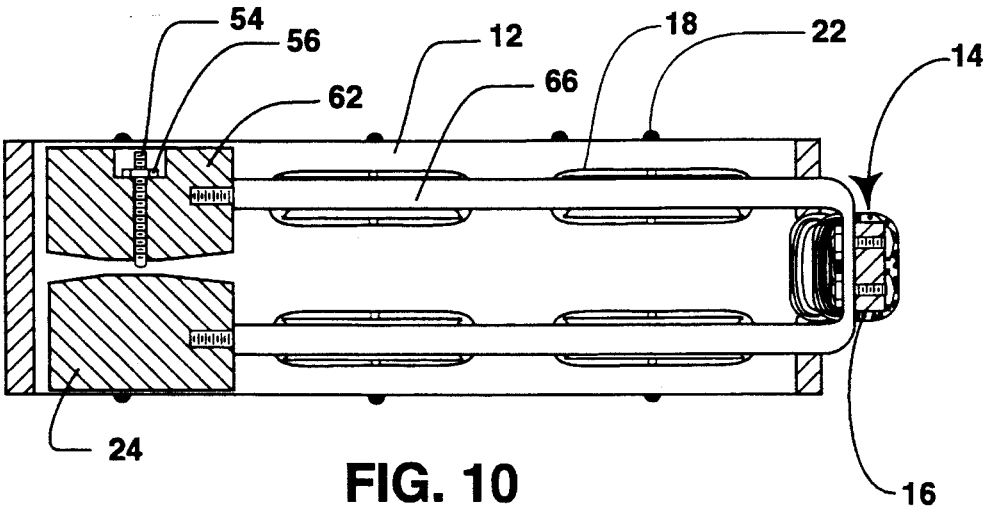
FIG. 10 is a cross section side view cut along the axis through the handle of the instant invention with a knock sound generating element and a striking element mounted on a rod.

FIG. 10 shows another implementation of the present invention comprised of a frame 12 and a handle 14 which includes suitable padding material 16 where both the knock sound generating element 24 and the striking element 62 are mounted to a rod 66 that is attached with conventional means to the handle side of the frame 12. The knock sound is generated when the instrument is played and hit along the axis of the frame 12 on either side that the striking element 62 is located on or on the side where the knock sound generating element 24 is located. The rod 66 bends which permits the striking element to impact the knock sound generating element. The gap between the striker element and the knock sound generating element can be controlled by adjusting the position of the bolt 54 and the locknut 56. This provides the ability to adjust the amount of effort required to generate the knock sound.

Figure 11:
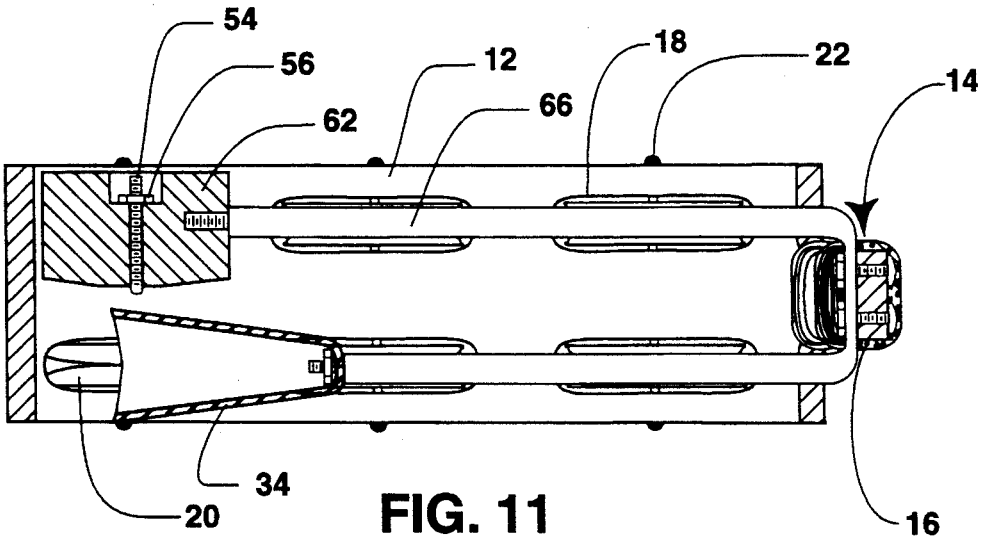
FIG. 11 is a cross section side view cut along the axis through the handle of the instant invention with a sound generating element and a striking element mounted on rod.

In FIG. 11 the knock sound generating element shown in FIG. 10 has been removed and replaced with a sound generating element, such as a cow bell 34. When the instrument is played and the player hits the striker element 62, the cow bell sound is generated in addition to the sound generated by the jingles. When the player hits the cow bell, a muted cow bell sound is generated because the player's hand muffles the cow bell sound. As previously described for FIG. 10, the effort required to generate the cow bell sound is controlled by adjusting the position of the bolt 54 and the locknut 56.

Figure 12:
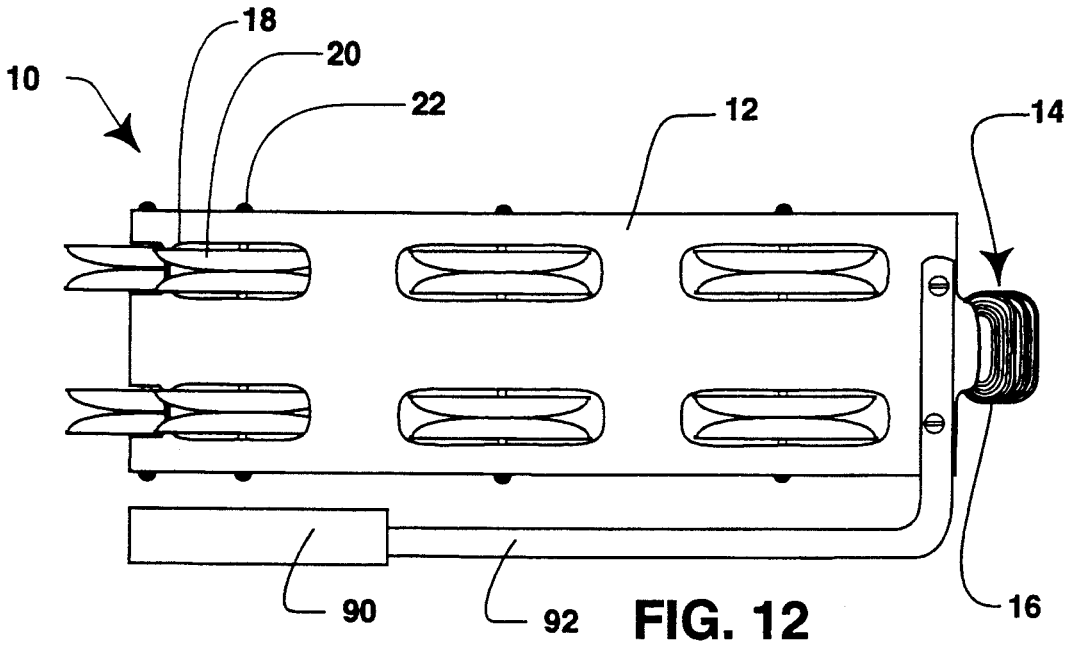
FIG. 12 is a side elevation view of the instant invention with a knock sound generating element mounted on a rod.
Figure 13:
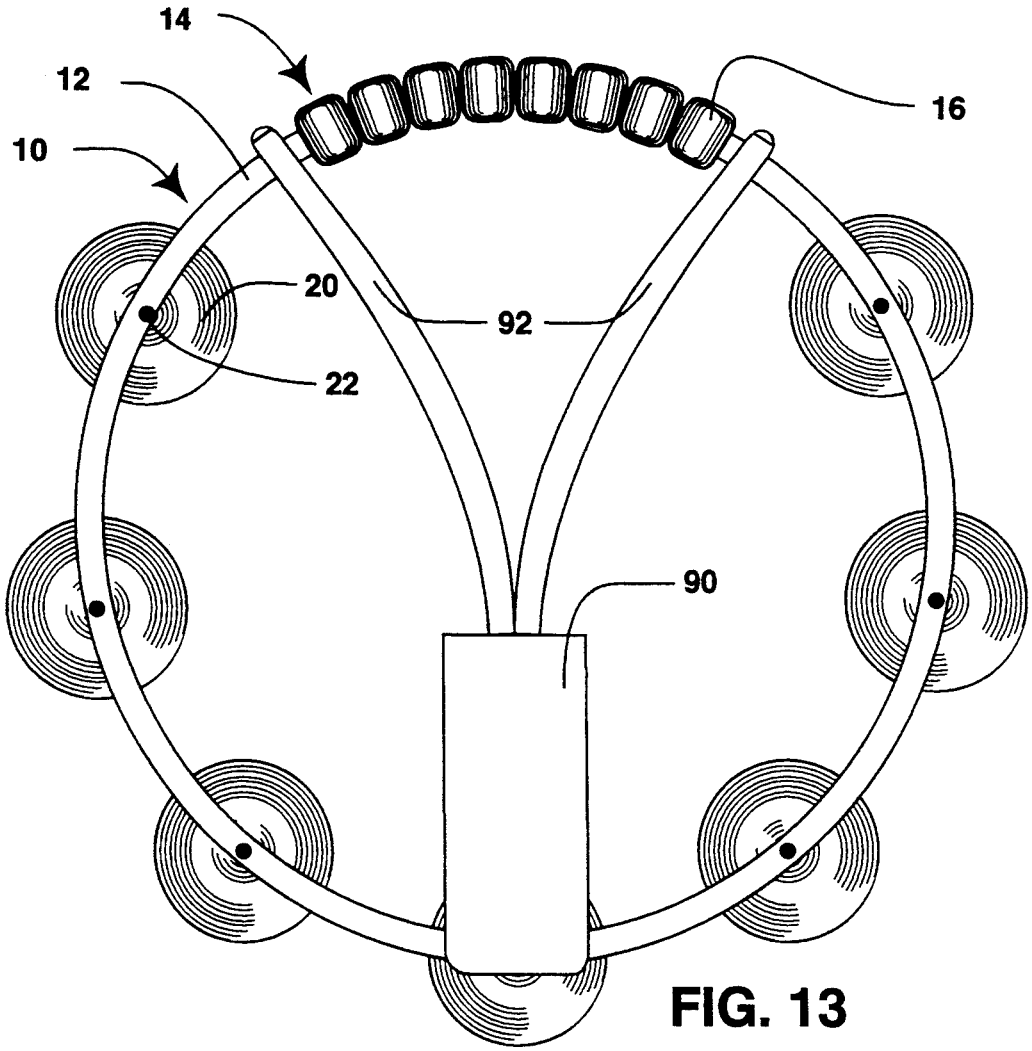
FIG. 13 is a bottom view of the instant invention with a knock sound generating element mounted on a rod.

FIG. 12 shows an alternative implementation of the present invention comprised of a frame 12 and a handle 14 which includes suitable padding material 16. A knock sound generating element 90 is attached to a rod 92 which is attached to the frame 12 close to the handle 14 with conventional means. It should be recognized that this configuration can be readily utilized to modify existing tambourines to generate additional sounds. The knock sound generating element is positioned so that there is a gap between the knock sound generating element 90 and the frame 12. The knock sound is generated when the instrument is hit on the knock sound generating element 90 or on the frame 12 along the axis of said frame and the knock sound generating element 90 strikes the frame 12, FIG. 13. The knocking sound is generated in addition to the sound generated by the jingles. Conventional means are provided in mounting the rod 92 to the frame 12 to permit adjustment of the gap between the knock sound generating element 90 and the frame 12. Adjusting the gap between the knock sound generating element 90 and the frame 12 changes the effort required to generate the knock sound. As previously described for the present invention, other sound generating elements could be similarly attached to the rod 92 in place of the knock sound generating element to produce the desired effect.

Figure 14:
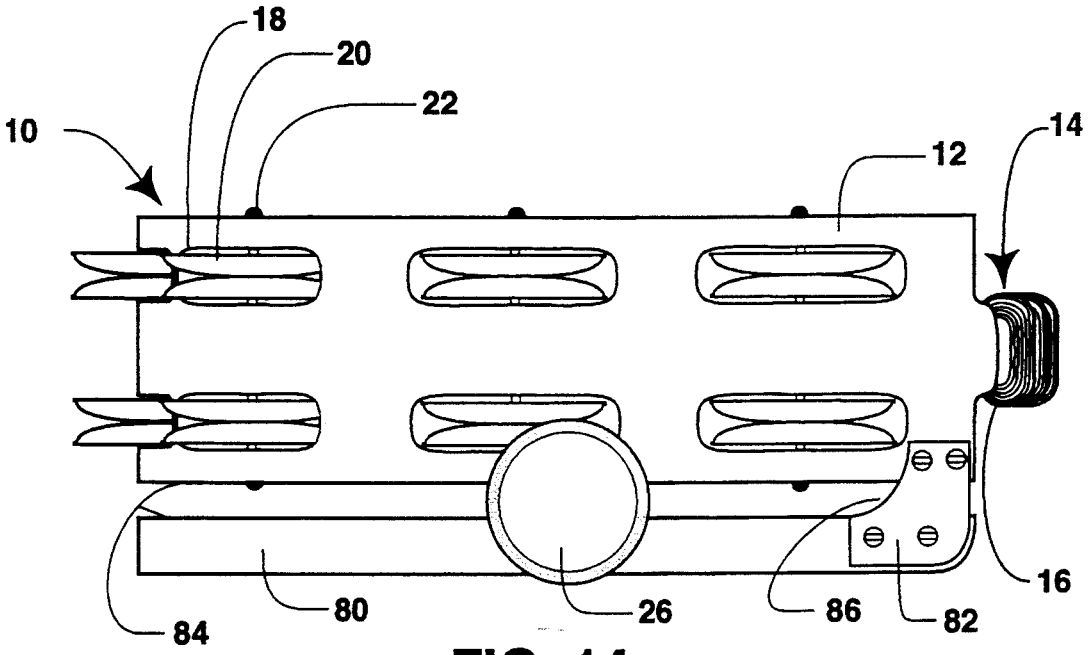
FIG. 14 is a side elevation view of the instant invention with a knock sound generating ring mounted to the frame.
Figure 15:
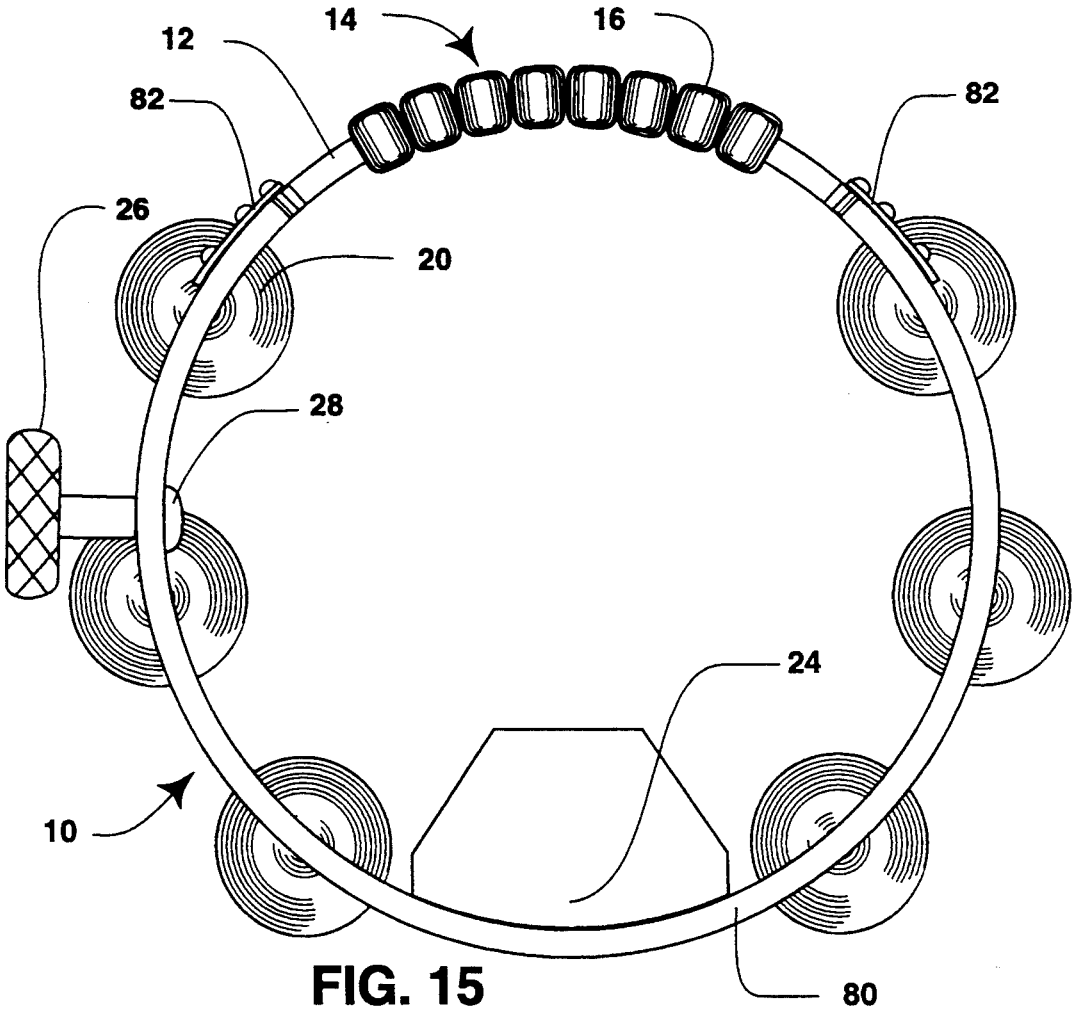
FIG. 15 is a bottom view of the instant invention with a knock sound generating ring mounted to the frame.

FIG. 14 shows an alternative implementation of the present invention comprised of a knock sound generating ring 80, attached with brackets 82 and conventional means to the frame 12, that creates a slot 84 between the frame 12 and the knock sound generating ring 80. A slot clamp 26 can also be inserted in the slot 84 on threaded post 28 as previously described. The knock sound is generated when the instrument is hit on the knock sound generating ring 80 along the axis of the frame 12 on the side of the frame opposite to the handle 14 and the knock sound generating ring 80 impacts the frame 12. The knock sound is generated in addition to the sound generated by the jingles. The slot clamp 26 is used to adjust the effort required to bend the knock sound generating ring 80 so that it impacts the frame 12 when played. The minimum effort required to generate the knock sound is when the slot clamp is positioned at the end of the slot 86 next to the brackets 82. When the slot clamp 26 is moved away from the end of the slot 86, the effort required to generate the knock sound increases. When the slot clamp 26 is positioned on the side of the frame 12 opposite to the handle 14, the knock sound generating ring 80 will not be able to bend toward the frame 12, therefore the knock sound will not be generated. With this embodiment, knock sound generating elements 24, as shown in FIG. 15, may be added to the knock sound generating ring 80 and to the frame 12 to achieve the desired tone and amplitude. As previously described for other implementations of the present invention, other sound generating elements could be similarly attached to generate the desired sounds.

Figure 16:
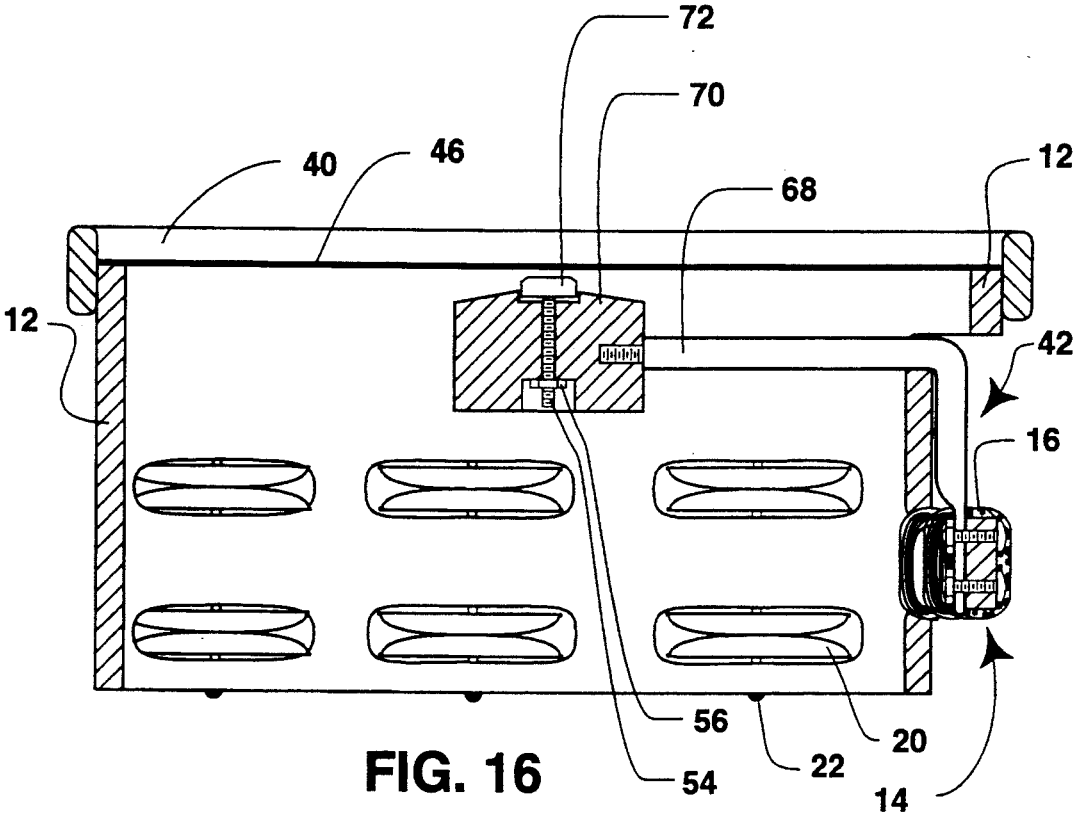
FIG. 16 is a cross section side view cut along the axis through the handle of the instant invention with a drum head mounted to the frame configured with a drum head striker mounted on a rod.

For tambourines with drum heads, the sound generated by striking the drum head with a stick can be created as shown in FIG. 16. A drum head striker 70 is mounted to a rod 68 that is attached to the frame 12 with conventional means. To prevent damage to the drum head 46, a padded striker button is attached to the end of the adjusting bolt 54. When the instrument is played and hit along the axis of the frame 12 on the edge of the drum head assembly 40 on the side of the frame 12 opposite to the handle 14, the rod 68 that the drum head striker 70 is mounted to bends which permits the drum head striker button 72 to impact the drum head 46. The gap between the drum head striker button 72 and the drum head 46 can be controlled by adjusting the position of the bolt 54 and the locknut 56. This provides the ability to adjust the amount of effort required to generate the drum hit sound.

When the instrument is played, the drum hit sound can be generated simultaneously with the sound generated by the jingles when the player hits the drum head assembly 40 side of the frame 12, see FIG. 16, opposite to the handle 14. This implementation has the additional feature of providing a time delay between the initial jingle sound and the drum hit sound. This is achieved by hitting the frame on the side opposite to the drum head assembly 40. As described for FIG. 8, hitting the side opposite to the drum head assembly 40 causes the rod 68 to bend away from the drum head. The restoring force on the rod 68 causes the drum head striker 70 to impact the drum head after the initial force is applied by the player. The amount of time delay between the jingle sound and the drum hit sound can be varied by the force applied by the player, the force required to bend the rod 68, the mass of the drum head striker 70, the distance between the drum head striker 70 and where the rod 68 is attached to the frame and the initial gap between the drum head striker 70 and the drum head 46.

Figure 17:
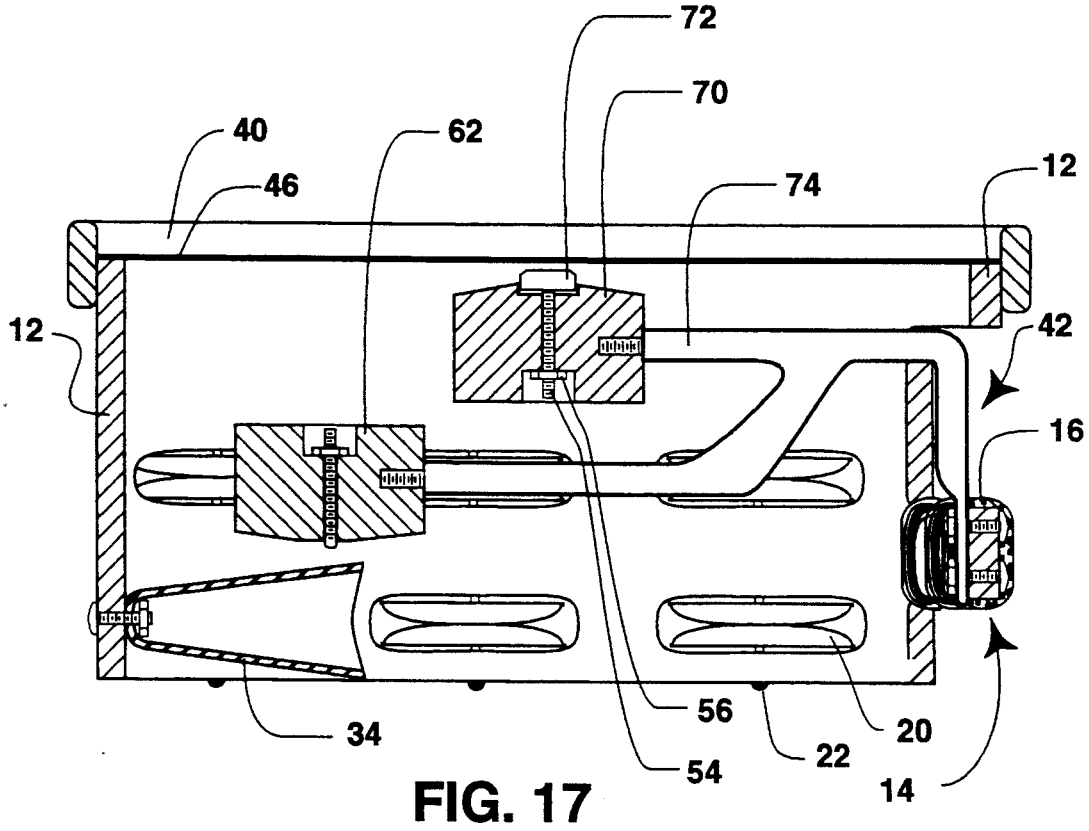
FIG. 17 is a cross section side view cut along the axis through the handle of the instant invention with a drum head mounted to the frame, a sound generating element mounted to the frame and a striking element and a drum head striker mounted on a rod.

FIG. 17 is a cross section side view of the instant invention with a drum head mounted to the frame configured to create drum hit and cow bell sounds in addition to the common jingle sound. A drum head striker element 70 and a striker element 62 are mounted at separate locations to a rod 74 that is attached to the frame 12 with conventional means. A cow bell 34 is mounted to the frame 12 on the side opposite to the handle and to the drum head. The gap between the drum head striker buttom 72 and the drum head 46 can be controlled by adjusting the position of the padded striker button 72 by turning the bolt 54 and securing it in place with the locknut 56. The gap between the striker element 62 and the cow bell 34 can be controlled by adjusting the position of the bolt 54 and secured in place with the locknut 56. When the instrument is played and hit along the axis of the frame 12 on the edge of the drum head assembly 40 on the side of the frame opposite the handle 14, the rod 74 bends which permits the drum head striking element to impact the drum head 46. When the instrument is played and hit along the axis of the frame 12 on the edge of said frame opposite to the drum head assembly on the side of the frame opposite the handle 14, the rod 74 bends which permits the striking element 62 to impact the cow bell 34. The capability to adjust the amount of effort to generate the drum hit sound and the cow bell sound independently provide significant control to the player over the sounds created by the instrument. An additional feature of this configuration is that the instrument can be adjusted so that the drum hit sound and the cow bell sound can be made to repeat rapidly for a short time after the instrument is hit. This is possible by adjusting the strikers, 62 and 70, so that the elastic rebound of the rod 74 will cause the opposite striker to impact either the drum head or the cow bell.

Figure 18:
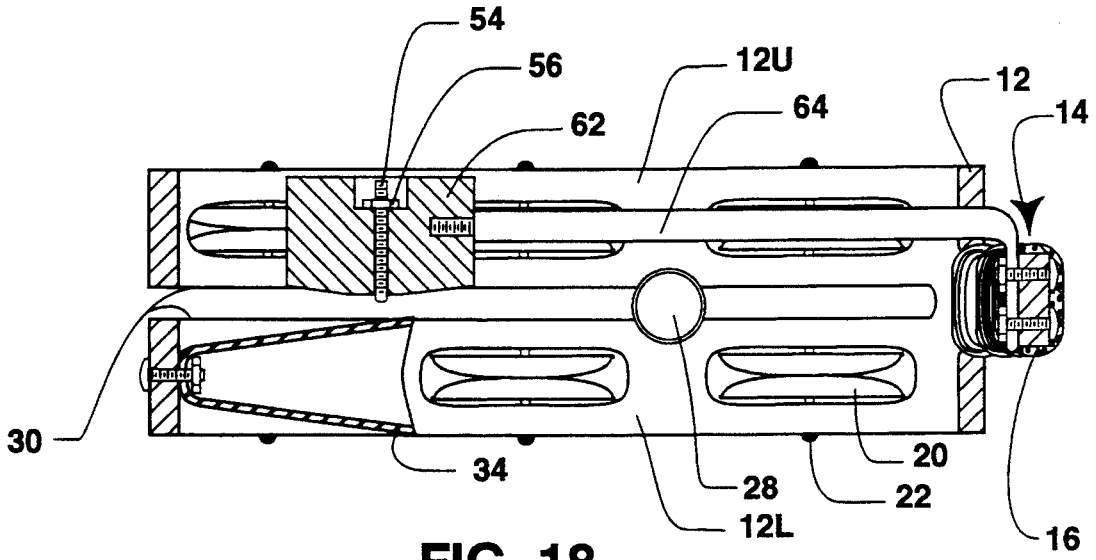
FIG. 18 is a cross section side view cut along the axis through the handle of the instant invention with a sound generating element mounted to the frame, a striking element mounted on a rod and a slot in the frame.

Combinations of the embodiments of the present invention described herein also produce tambourines with unique features. In FIG. 18 the slot 30 is formed in the frame to create upper and lower halves of the frame 12U and 12L respectively. The sound generating element, shown as a cow bell 34, is mounted to the lower half of the frame 12L. The striker element 62 is mounted to a rod 64 which is attached to the handle side of the frame 12. The gap between the striker element 62 and the sound generating element, shown as a cow bell 34, can be adjusted to control the amount of effort required to generate the cow bell sound. The effort required to cause the upper and lower halves of the frame, 12U and 12L respectively, to strike each other can be varied by moving the slot clamp 26 along the slot 30 as previously described.

With the embodiment shown in FIG. 18 two sounds, the knock and the cow bell, in addition to the jingle sound can be generated by the player. The knock sound is generated with the jingle sound when the two halves of the frame impact each other. This is accomplished by hitting the instrument along the axis of the frame 12 on the side of the frame opposite the handle 14, on either the upper or lower half of the frame. The cow bell sound is generated with the jingle sound when the striker element impacts the cow bell. This is accomplished when the player hits the striker element 62 along the axis of the frame 12. The rod 64 that the striker element 62 is mounted to bends which permits the striker element 62 to impact the cow bell 34. The muffled cow bell sound is generated with the jingle sound when the player hits the cow bell 34 along the axis of the frame. The rod 64 that the cow bell 34 is mounted to bends, which permits the striker element 62 to impact the cow bell 34. The players hand on the cow bell 34 muffles the cow bell's tone. Three sounds, jingle, knock and cow bell can be generated when the player hits the frame 12 and the striker element 62 along the axis of the frame 12 at the same time. A variation of these three sounds, jingle, knock and muffled cow bell can be generated when the player hits the frame 12 and cow bell 34 along the axis of the frame 12 at the same time. It is a further feature that the effort required to generate the additional sounds can be individually controlled by the player. The knock sound is controlled by adjusting the slot clamp 26 and the cow bell sound is controlled by adjusting the adjusting bolt 54 and secured in place with the locknut 56.

Figure 19:
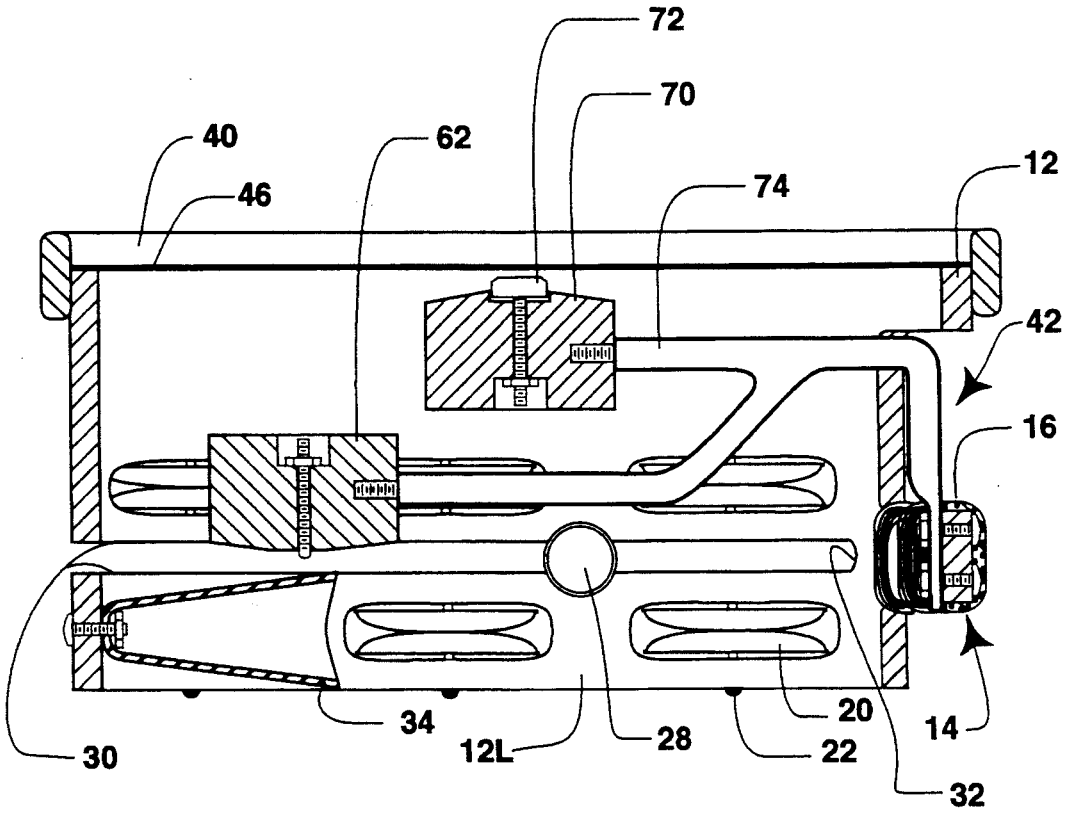
FIG. 19 is a cross section side view cut along the axis through the handle of the instant invention with a drum head mounted to the frame, a sound generating element mounted to the frame, a striking element and a drum head striker mounted on a rod and a slot in the frame.

FIG. 19 is a cross section side view of the instant invention with a drum head assembly 40 mounted to the frame 12 configured to create a drum hit, a cow bell sound and a knock sound in addition to the conventional jingle sound. The slot 30 that is formed in frame 12 extends from one side of the handle 14 to the other side of said handle with the end shown as 32 and creates the lower half of the frame 12L. A drum head striker element 70 and a striker element 62 are mounted at separate locations to a rod 74 that is attached to the frame with conventional means. A sound generating element, shown as a cow bell 34, is mounted to the lower half of the frame 12L on the side opposite to the handle.

The effort required to cause the lower half of the frame, 12L, to strike the frame 12, thus creating the knock sound, can be varied by moving the slot clamp 26 along the slot 30. The gap between the drum head striker button 72 and the drum head 40 can be controlled by adjusting the position of the padded striker button 72 by turning the bolt 54 and securing it in place with the locknut 56. The gap between the striker element 62 and the cow bell 34 can be controlled by adjusting the position of the bolt 54 and secured in place with the locknut 56.

From the previous teachings it can be understood how the adjustments would be made to create the sound desired. Because of the independent adjustment of each additional sound, it is possible to create one, two or three additional sounds with the jingle sound. This configuration of the instrument can also be adjusted so that the drum hit sound and the cow bell sound can be made to repeat rapidly for a short time after the instrument is hit.

The present invention has been shown and described herein in what are considered to be the most practical and preferred embodiments. It is recognized, however, that departures may be made therefrom within the scope of the invention and that obvious modifications will occur to a person skilled in the art.

What I claim is:

1. An improved tambourine whereby in operation the player can generate a knock sound with the instrument in addition to the sound generated by the jingles, comprising:

(a) a rigid enclosed frame with open ends;

(b) a plurality of pairs of jingle sound generating elements connected to said frame in openings in the side of said frame at predetermined locations;

(c) a handle for manually grasping said frame;

(d) a slot formed perpendicular to the axis of said frame that extends around the perimeter of said frame a sufficient distance to permit the two sides formed above and below the slot to bend toward each other and touch when struck by the player, which creates a knocking sound when the two sides of the frame impact each other.

2. An improvided tambourine as in claim 1, further comprising a clamp inserted in the slot in said frame that can be positioned at any location along the slot to control the amount of effort required to cause the two sides of the slot to bend toward each other when said frame is struck by the player.

3. An improved tambourine as in claim 1, wherein the shape of the rigid frame is a circle.

4. An improved tambourine as in claim 1, further comprising knock sound generating elements mounted to the frame on both sides of the slot, opposite to the handle to increase the amplitude of the knock or to change the tone of the knock.

5. An improved tambourine as in claim 1, further comprising a sound generating element mounted to the frame on one side of the slot and a striker element mounted to the frame on the other side of the slot, both said elements mounted opposite to the handle.

6. An improved tambourine whereby in operation the player can generate a knock sound with the instrument in addition to the sound generated by the jingles and by the drum head, comprising:

(a) a rigid enclosed frame with open ends;
(b) a drum head mounted to one end of said frame;
(c) a plurality of pairs of jingle sound generating elements connected to said frame in openings in the side of said frame at predetermined locations;
(d) a handle for manually grasping said frame;
(e) a slot formed perpendicular to the axis of said frame that extends around the perimeter of said frame a sufficient distance to permit the two sides formed above and below the slot to bend toward each other and touch when struck by the player, which creates a knock sound when the two sides of the frame impact each other.

7. An improved tambourine as in claim 6, further comprising a clamp inserted in the slot in said frame that can positioned at any location along the slot to control the amount of effort required to cause the two sides of the slot to bend toward each other when struck by the player.

8. An improved tambourine as in claim 6, wherein the shape of the rigid frame is a circle.

9. An improved tambourine as in claim 6, further comprising knock sound generating elements mounted to the frame on both sides of the slot, opposite to the handle to increase the amplitude of the knock or to change to tone of the knock.

10. An improved tambourine as in claim 6, further comprising a sound generating element mounted to the frame on one side of the slot and a striker element mounted to the frame on the other side of the slot, both of said elements mounted opposite to the handle.

11. An improved tambourine, as in claim 9 further comprising (a) a lever mounted between the knock sound generating elements so that the end of the lever that extends to the center of said frame moves toward the drum head when the upper and lower halves of the frame bend toward each other;
(b) a center support that is mounted to said frame with an opening in the center along the axis of said frame;
(c) a drum head striker that moves freely in the opening in the center support along the axis of said frame that is of sufficient length so that when the drum head striker is touching the lever, the opposite end of the drum head striker is in close proximity to the drum head;

whereby in operation a drum hit sound is generated when the player strikes said frame, the upper and lower halves of the frame bend toward each other, which causes the lever to push against the drum head striker and force the drum head striker into the drum head thereby generating a drum hit sound.

12. An improved tambourine as in claim 11, further comprising conventional means to change the gap between the drum head striker and the drum head which results in adjusting the amount of effort required by the player to generate the drum hit sound.

13. An improved tambourine as in claim 11, further comprising springs attached between the drum head striker and the center support to return the drum head striker back to the initial position each time that it is actuated by the player.

14. An improved tambourine whereby in operation the player can generate a sound with the instrument in addition to the sound generated by the jingles, comprising:

(a) a rigid enclosed frame with open ends;
(b) a plurality of pairs of jingle sound generating elements connected to said frame in openings in the side of said frame at predetermined locations;
(c) a handle for manually grasping said frame;
(d) a sound generating element mounted to the frame opposite to the handle side of the frame;
(e) a striker element mounted to a rod that is attached to the handle side of the frame that is positioned to impact the sound generating element when the instrument is struck by the player.

15. An improved tambourine as in claim 14, further comprising conventional means to adjust the distance between the sound generating element and the striker element to control the amount of effort required to cause the sound generating element and the striker element to impact each other.

16. An improved tabourine as in claim 14, wherein the shape of the rigid frame is a circle.

17. An improved tambourine as in claim 14, wherein the sound generating element is a knock sound generating element that is tuned to generate the desired amplitude and tone.

18. An improved tambourine as in claim 14, further comprising a drum head mounted to one of the open ends of the frame.

19. An improved tambourine whereby in operation the player can generate a sound with the instrument in addition to the sound generated by the jingles, comprising:

(a) a rigid enclosed frame with open ends;
(b) a plurality of pairs of jingle sound generating elements connected to said frame in openings in the side of said frame at predetermined locations;
(c) a handle for manually grasping said frame;
(d) a sound generating element mounted to a rod that is attached to the handle side of the frame;
(e) a striker element mounted to a rod that is attached to the handle side of the frame that is positioned to impact the sound generating element when the instrument is struck by the player.

20. An improved tambourine as in claim 19, further comprised of conventional means to adjust the distance between the sound generating element and the striker element to control the amount of effort required to cause the sound generating element and the striker element to impact each other.

21. An improved tambourine as in claim 19, wherein the shape of the rigid frame is a circle.

22. An improved tambourine as in claim 19, wherein the sound generating element is a knock sound generating element that is tuned to generate the desired amplitude and tone.

23. An improved tambourine as in claim 19, further comprising a drum head mounted to one of the open ends of the frame.

24. An improved tambourine whereby in operation the player can generate a sound with the instrument in addition to the sound generated by the jingles, comprising:

(a) a rigid enclosed frame with open ends;
(b) a plurality of pairs of jingle sound generating elements connected to said frame in openings in the side of said frame at predetermined locations;
(c) a handle for manually grasping said frame;
(d) a sound generating element mounted to a rod that is attached to the handle side of the frame positioned so that the sound generating element will strike the edge of the open ended frame when struck by the player.

25. An improved tambourine as in claim 24, further comprising conventional means to adjust the distance between the knock sound generating element and the frame to control the amount of effort required to cause the sound generating element and the frame to strike each other.

26. An improved tambourine as in claim 24, wherein the shape of the rigid frame is a circle.

27. An improved tambourine as in claim 24, wherein the sound generating element is a knock sound generating element that is tuned to generate the desired amplitude and tone.

28. An improved tambourine as in claim 24, further comprising a drum head mounted to one of the open ends of the frame.

29. An improved tambourine whereby in operation the player can generate a sound with the instrument in addition to the sound generated by the jingles, comprising:

(a) a rigid enclosed frame with open ends;
(b) a plurality of pairs of jingle sound generating elements connected to said frame in openings in the side of said frame at predetermined locations;
(c) a handle for manually grasping said frame;
(d) a rigid ring that is the same general size and shape of the open end of said frame and has a sector removed from said ring that corresponds to the arc length of the handle for grasping said frame;
(e) brackets that mount the rigid ring to said frame;
(f) a slot that is formed between the rigid ring and said frame which extends around the perimeter of the rigid ring a sufficient distance to permit the rigid ring to bend toward the said frame when struck by the player, which creates a knock sound when the rigid ring impacts said frame.

30. An improved tambourine as in claim 29, further comprising a clamp inserted in the slot between said frame and the rigid ring that can be positioned at any location along the slot to control the amount of effort required to cause the rigid ring to impact said frame and generate a knock sound.

31. An improved tambourine as in claim 29, wherein the shape of the rigid ring is a circle to conform to the cylindrical shape of said frame.

32. An improved tambourine as in claim 29, further comprising a drum head mounted to one of the open ends of the frame.

33. An improved tambourine whereby in operation the player can generate a sound with the instrument in addition to the sound generated by the drum head and the jingles, comprising:

(a) a rigid enclosed frame with open ends;
(b) a drum head mounted to one of the open ends of said frame;
(c) a plurality of pairs of jingle sound generating elements connected to said frame in openings in the side of said frame at predetermined locations;
(d) a handle for manually grasping said frame;
(e) a striker element mounted to a rod that is attached to the handle side of the frame that is positioned to strike the drum head when struck by the player.

34. An improved tambourine as in claim 33, further comprising conventional means to adjust the distance between the drum head striker and the drum head to control the amount of effort required to cause the drum head striker to impact the drum head.

35. An improved tambourine as in claim 33, wherein the shape of the rigid frame is a circle.

36. An improved tambourine as in claim 33, further comprising:

(a) a sound generating element mounted to the frame opposite to the handle side of the frame;
(b) an extension to said rod that the drum head striker is mounted to that permits the mounting of a second striking element to said rod that is positioned to impact the sound generating element.

37. An improved tambourine whereby in operation the player can generate a sound with the instrument in addition to the sound generated by the jingles, comprising:

(a) a rigid enclosed frame with open ends;
(b) a plurality of pairs of jingle sound generating elements connected to said frame in openings in the side of said frame at predetermined locations;
(c) a handle for manually grasping said frame;
(d) a slot formed perpendicular to the axis of said frame that extends around the perimeter a sufficient distance to permit the two sides formed above and below the slot to bend toward each other and touch when struck by the player, which creates a knock sound when the two sides of the frame impact each other;
(e) a sound generating element, mounted to the lower half of the frame opposite to the handle side of the frame;
(f) a striker element mounted to a rod that is attached to the handle side of the frame that is positioned to strike the sound generating element when the frame is struck by the player.

38. An improved tambourine as in claim 37, further comprising a clamp inserted in the slot in said frame that can positioned at any location along the slot to control the amount of effort required to cause the two sides of the slot to bend toward each other when said frame is struck by the player.

39. An improved tambourine as in claim 37, further comprising conventional means to adjust the distance between the sound generating element and the striker to control the amount of effort required to cause the sound generating element and the striker element to impact each other.

40. An improved tambourine as in claim 37, wherein the shape of the rigid frame is a circle.

41. An improved tambourine as in claim 37, further comprising a drum head mounted to one of the open ends of the frame.

42. An improved tambourine whereby in operation the player can generate a sound with the instrument in addition to the sound generated by the drum head and the jingles, comprising:

(a) a rigid enclosed frame with open ends;

(b) a drum head mounted to one end of said frame;

(c) a plurality of pairs of jingle sound generating elements connected to said frame in openings in the side of said frame at predetermined locations;

(d) a handle for manually grasping said frame;

(e) a slot formed perpendicular to the axis of said frame that extends around the perimeter a sufficient distance to permit the two sides formed above and below the slot to bend toward each other and touch when struck by the player, which creates a knock sound when the two sides of the frame impact each other;

(f) a sound generating element, mounted to the lower half of the frame opposite to the handle side of the frame;

(g) a striker element mounted to a rod that is attached to the handle side of the frame that has one striking face positioned to impact the drum head and a second striking face positioned to impact the sound generating element when the instrument is struck by the player.

43. An improved tambourine as in claim 42, further comprising a clamp inserted in the slot in said frame that can positioned at any location along the slot to control the amount of effort required to cause the two sides of the slot to bend toward each other when said frame is struck by the player.

44. An improved tambourine as in claim 42, further comprising conventional means to adjust the distance between the sound generating element and the striker element to control the amount of effort required to cause the sound generating element and the striker element to impact each other.

45. An improved tambourine as in claim 42, further comprising conventional means to adjust the distance between the drum head and the drum head striker to control the amount of effort required to cause the drum head striker to impact the drum head.

46. An improved tambourine as in claim 42, wherein the shape of the rigid frame is a circle.

* * * * *